US005582509A

United States Patent [19]

Quilty et al.

[11] Patent Number: 5,582,509

[45] Date of Patent: Dec. 10, 1996

[54] CIRCULATING ASPIRATOR WITH IMPROVED TEMPERATURE CONTROL

[75] Inventors: John H. Quilty, Rodeo; Keith Kaste, El Cerrito, both of Calif.

[73] Assignee: Bio-Rad Laboratories, Inc., Hercules, Calif.

[21] Appl. No.: 516,240

[22] Filed: Aug. 17, 1995

[51] Int. Cl.[6] ..... F04B 23/04

[52] U.S. Cl. ..... 417/77; 417/87; 34/75

[58] Field of Search ..... 417/77, 87; 34/75, 34/407

[56] References Cited

U.S. PATENT DOCUMENTS

| | | | |
|---|---|---|---|
| 1,287,169 | 12/1918 | Young | 417/77 |
| 2,528,476 | 10/1950 | Roos et al. | 34/75 X |
| 2,702,664 | 2/1955 | Plenaar | 417/77 |
| 3,007,322 | 11/1961 | Dodge | 34/407 |

OTHER PUBLICATIONS

Bio–Rad Bulletin on The Complete System for All Gel Drying.

Brinkmann Advertisement on Büchi Recirculating Water Aspirator.

Cole–Parmer Instrument Company Advertisement on Portable Water–Jet Aspirator Pumps.

Integrated Separation Systems Advertisement on UniJet II Vacuum Pump.

Brinkmann Advertisement on Büchi B–169 Vacuum System.

*Primary Examiner*—Richard E. Gluck

*Attorney, Agent, or Firm*—Townsend and Townsend and Crew LLP

[57] ABSTRACT

A vacuum aspirator apparatus uses circulating water from a reservoir while avoiding or reducing temperature rise in the circulating water. The apparatus consists of a reservoir with aspiration and cooling circuits, both of which are external to the reservoir, the aspiration circuit containing one or more aspirators with vacuum ports at which a vacuum can be drawn.

9 Claims, 1 Drawing Sheet

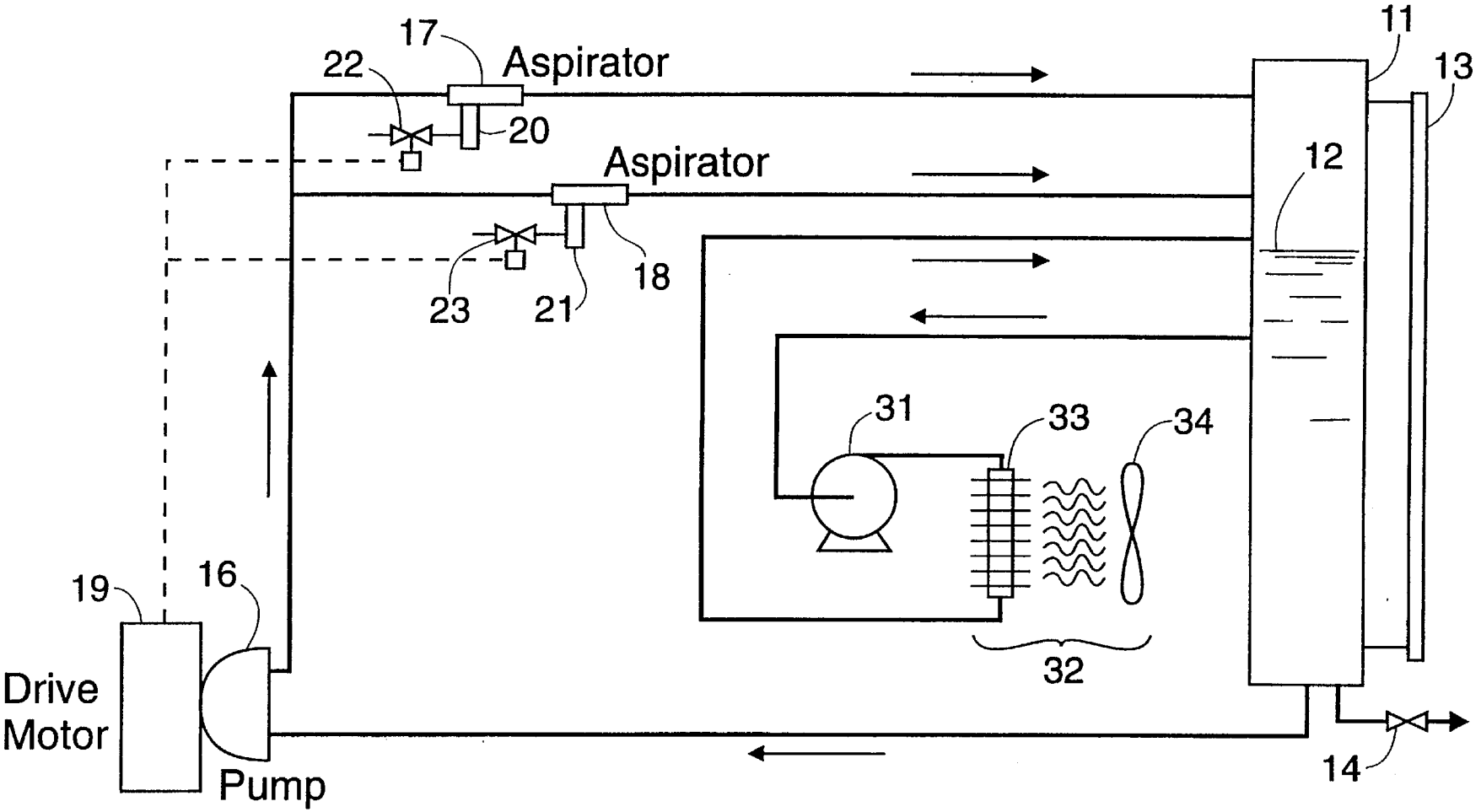
13
11
12
14
34
33
32
31
Aspirator
Aspirator
18
21
20
17
23
22
Pump
16
19
Drive
Motor

CIRCULATING ASPIRATOR WITH IMPROVED TEMPERATURE CONTROL

This invention relies in the field of laboratory equipment, and particularly vacuum pumps.

BACKGROUND OF THE INVENTION

Vacuum pumps and aspirators are common pieces of equipment in analytical, chemical synthesis and clinical laboratories, where they are useful for solvent removal from reaction product, vacuum filtration, and similar small-scale tasks. Biochemical laboratories utilize vacuum in a variety of procedures, one of the most common being the drying of gels in which any of various different types of electrophoresis has been performed. Other procedures and equipment with which vacuum is used include freeze drying, rotary evaporators, vacuum concentrators, distillation apparatus, filtering flasks, degassing equipment, desiccation, fume and vapor removal, vacuum dialysis, and vacuum ovens.

Pumps which draw vacuum directly include a vapor trap to protect the pump from corrosive vapors which might damage the pump. The oil used in these pumps must be periodically drained from both the vapor trap and the pump itself, and the pumps still entail a risk of drawing too great a vacuum and mining the experiment. There are also the risks of drawing destructive materials into the pump, requiring costly repairs or replacement of the pump itself, and of expelling oil from the pump into the surrounding air. Other disadvantages are the cost of the oil and the problem of disposal of used oil. The use of these pumps to dry gels further presents the risk of releasing acetic acid into the atmosphere, since acetic acid is entrained with the water drawn from the gel by the vacuum.

Aspirators, or water jet pumps, are widely used in place of vacuum pumps, since aspirators avoid many of the dangers and operating costs associated with oil-based pumping systems. Aspirators are particularly useful for drying gels, since the water in an aspirator serves as an effective trap for the acetic acid. The simplest aspirators are those that are connected directly to a tap water line, where one can simply turn on the tap to start the vacuum. These aspirators are not reliable, of course, at locations where water pressure is low or unsteady. The greatest disadvantage, however, is the high consumption of water. Operators often forget that the tap is running or are too preoccupied to turn it off, leaving it on for hours and wasting precious tap water.

To avoid wastage of water, self-contained aspirator vacuum systems are currently marketed. The typical system contains a water tank with a motor-driven circulating pump immersed in the tank. The pump draws water from the tank and forces the water through one or more aspirators that are part of the system itself, before returning the water to the tank. A disadvantage of these systems is that the metallic pump shaft is immersed in the water and readily conducts the heat generated by the pump to the water, causing the water temperature to rise. This causes the flow rate to drop, which in turn results in a weaker vacuum. A large pump motor is often used in an attempt to compensate for this, but the result is a faster rise in temperature.

SUMMARY OF THE INVENTION

The limitations enumerated above are overcome by the present invention, which resides in a water aspirator system in which the aspirator(s) and the pump feeding them are external to the water tank and are fed by tubing drawing the water from the tank and returning it to the tank, and which also contains a cooling circuit that cools water outside the tank and returns it cooled. This arrangement allows the aspirator pump to be cooled separately, by the surrounding air or any means other than the water in the tank, and provides a direct means of cooling the circulating water rather than using the circulating water itself as a coolant medium. The system thus maintains its flow rate and vacuum level for a considerably longer period of time during continuous use than systems of the prior art. With the aspiration pump and aspirator(s) thus removed from the water tank, the system of this invention also permits the discharge water from the aspirator(s) to be returned to the tank as a relatively continuous stream rather than a jet, the stream reducing the churning of the water in the tank. This reduces the quantity of air bubbles entrained in the water passing through the aspirator(s), and this is another means of maintaining a high vacuum level in the aspirator(s). The aspiration and cooling circuits can have a common pump external to the tank, or the cooling circuit can be completely independent of the aspirator circuit, with separate pumps for each, both external to the tank.

These and other features and advantages of the invention will become evident from the description that follows.

BRIEF DESCRIPTION OF THE DRAWING

The drawing included herewith is a schematic diagram of a water aspirator apparatus representing one embodiment of this invention.

DETAILED DESCRIPTION OF THE INVENTION AND THE PREFERRED EMBODIMENT

While the system and apparatus of this invention can vary widely in its component parts and in their arrangement and configuration, the invention as a whole will be better understood by a detailed examination of one embodiment of the invention. The drawing depicts one such embodiment.

The reservoir or water tank 11 serves as the source of water for the aspirators. The shape and capacity of the tank are not critical to the invention and can vary widely. In this particular embodiment, the tank has a capacity of about 5 liters. During setup of the system for use, the tank is not filled to capacity, but instead only to a preselected water level 12, which in this particular embodiment is the level corresponding to 4 liters. The actual water level is visible in a sight glass 13.

When the system is used for drying gels, water from the gels will accumulate in the tank causing the water level to rise. In addition, and regardless of what the vacuum is to be drawn on, the water may have to be changed after extended use. For these reasons, the tank has a drain line 14 to which a quick disconnect fitting can be attached.

Water from the bottom of the tank is drawn into an aspirator circuit that consists of an aspirator pump 16, two aspirators 17, 18 connected in parallel, and connective tubing joining these components to each other and to the tank 11. The aspirator pump 16 is situated outside the water tank 11 to reduce the rate of temperature rise in the tank from the pump itself. In the preferred embodiment, the aspirator pump 16 is a positive displacement rotary vane pump, but any conventional water pump of appropriate rating can be used. The flow rate and outlet pressure of the pump can vary, although in most applications pumps rated at 200 to 300 gallons per hour (GPH) (0.21–0.32 liters per second) with a maximum outlet pressure ranging from 200 to 300 pounds per square inch (psi) (13.6–20.4 bar) will provide the best results. The preferred pump has a rating of 240 GPH (0.25 liters per second) and a maximum outlet pressure of 250 psi (17.0 bar). The drive motor 19 for the pump in this preferred embodiment is a universal voltage ⅓ horsepower (25 kilogram-force-meter per second) AC pump with nominal rotational speed of 1725 revolutions per minute (rpm) at 60 Hz, and 1540 rpm at 50 Hz. The pump is clamped to the motor by a spring clamp.

The outlet of the pump 16 is directed through the aspirators 17, 18. Systems in accordance with this invention can contain as few as one aspirator or as many as several. The system shown in the drawing contains two aspirators, the pump outlet being divided equally between the two. Conventional aspirators can be used. One such aspirator is a venturi-type injector. An example of such an element is the Model 384X venturi-type injector obtainable from Mazzei Injector Corporation, Bakersfield, Calif., USA. This injector is nominally rated at a flow of 33 standard cubic feet per hour (SCFH) (15.6 liters per minute) at 120 GPH (0.12 liters per second) with zero outlet backpressure. The discharge from each aspirator is returned to the tank 11 at a location above the water level 12.

Each aspirator contains a vacuum port 20, 21 for attachment of the vent line of the unit on which a vacuum is to be drawn. Thus, the system can simultaneously draw vacuum on two separate units, or be used for two distinct purposes. For safety purposes, these aspirators can contain check valves or other conventional means of preventing backflow of water in the event of a power failure. In the system shown in the drawing, the vacuum ports 20, 21 each have an automatic vent valve 22, 23 to vent the vacuum line in the event of an unexpected shutdown of the pump 19. These vent valves are normally-open solenoid valves that remain closed as long as the drive motor 19 is in operation and that open immediately when the power is shut off.

The cooling circuit consists of a circulation pump 31, a heat exchanger 32, and connective tubing joining these components to each other and to the tank 11. The cooling circuit is not part of the aspirator circuit, and vice versa, the two circuits being entirely independent and sharing no common elements other than the tank 11 itself. The cooling circuit draws water from the tank 11 at a level which is approximately mid-height in the tank, and returns the cooled water to the location above the liquid level 12.

The circulation pump 31 can be any conventional water pump. In the preferred embodiment, the pump is a magnetic drive pump with a nominal rating of 2 to 3 gallons per minute (GPM) (0.13–0.19 liter per second). The heat exchanger 32 can be any conventional element, using either air, water or any other liquid or gas as a heat exchange medium. In the embodiment shown in the drawing, the heat exchanger consists of a finned condenser 33 cooled by a fan 34, the fan rated at 100 cubic feet per minute (CFM) (47,200 cubic centimeters per second).

In an alternative to the arrangement shown above, the circulation pump 31 and its inlet line can be eliminated, and the aspiration pump 16 can used to drive both the aspiration and cooling circuits. To achieve this arrangement, the discharge from the aspiration pump can be divided into two lines, one directing a portion of the discharge to the aspirators 17, 18 and the other directing the remaining portion to the finned condenser 33. The cooled water leaving the condenser 33 will then proceed as shown in the drawing.

For purposes of establishing and maintaining a vacuum adequate for biochemical procedures such as gel drying, the water must be maintained at a temperature below about 35° C. Accordingly, the components of the aspirator system of the present invention are preferably sized, selected and assembled to provide a system which is capable of maintaining a temperature significantly below 35° C., and most preferably below about 30° C., for several hours of continuous use.

In either of these two arrangements as well as any others within the scope of this invention, the apparatus as a whole can include further elements that are not critical to its basic function but still useful. A vacuum gauge, for example, can be included on each vacuum port or for both ports simultaneously. The apparatus will generally be designed to produce a vacuum within the range of 26 to 30 inches of mercury (0.86–1.0 atmospheres). The gauge may therefore provide a visual warning when the vacuum level drops below 26 inches of mercury. A combination power switch and timer can also be included, providing the user with the option of total manual control or an automatic shutoff after a selected period of time.

The apparatus can be constructed of conventional materials used in laboratory apparatus, the only requirement being that portions of the apparatus bearing elevated pressures should be constructed of materials capable of reliably withstanding the pressure. The drain line 14 and the outlet lines of the two pumps 16, 31 might therefore be constructed of a material such as polyvinyl chloride with a nylon inner braid.

As indicated above, the apparatus of this invention is useful in the drying of electrophoresis gels, as well as in other procedures and equipment with which vacuum is used, examples of which are freeze drying, rotary evaporators, vacuum concentrators, distillation apparatus, filtering flasks, degassing equipment, desiccation, fume and vapor removal, vacuum dialysis, and vacuum ovens.

The foregoing is offered primarily for purposes of illustration. It will be readily apparent to those skilled in the art that the elements of the system, as well as their arrangements, dimensions, capacities, and operation ratings, and any other parameters of the system described herein may be further modified or substituted in various ways without departing from the spirit and scope of the invention.

We claim:

1. A water aspirator system comprising:

(a) a reservoir capable of retaining a body of water;

(b) an aspirator circuit comprising:

(i) a pump external to said reservoir and connected thereto through an inlet line arranged to draw water from said reservoir and a discharge line arranged to return water to said reservoir; and (ii) at least one aspirator on said discharge line; and (c) a cooling circuit comprising means for drawing water from said reservoir into a heat exchanger where said water thus drawn is cooled, and for returning water thus cooled to said reservoir.

2. A water aspirator system in accordance with claim 1 in which said heat exchanger is an air-cooled finned heat exchanger.

3. A water aspirator system in accordance with claim 1 in which said reservoir has a bottom and side walls and a designated nominal water level, and said pump is connected to said reservoir to draw water from a location therein at or adjacent to said bottom and to return water thereto to a location above said designated nominal water level.

4. A water aspirator system in accordance with claim 1 in which said pump is defined as a first pump, said reservoir has a bottom and side walls and a designated nominal water level, and said cooling circuit comprises a second pump arranged to draw water from a location below said designated nominal water level and to return water to a location above said designated nominal water level.

5. A water aspirator system in accordance with claim 1 and which said pump is driven by a drive motor, said aspirator system further comprising an electrically operated vent shut-off valve arranged to vent said aspirator to the atmosphere when said drive motor is shut off.

6. A water aspirator system in accordance with claim 1 and which said pump is a positive displacement rotary vane pump.

7. A water aspirator system in accordance with claim 1 and which said aspirator circuit contains two of said aspirators, arranged in parallel.

8. A water aspirator system in accordance with claim 1 in which said reservoir has a designated nominal water level, and said system further comprises a level indicator providing a continuously readable indication of water level in said reservoir.

9. A water aspirator system in accordance with claim 1 in which said pump is defined as a first pump, said cooling circuit is independent of said aspirator circuit and comprises:

(i) a second pump external to said reservoir and arranged to draw water therefrom and return water thereto; and (ii) means for cooling water drawn by said second pump prior to return of said water to said reservoir.

* * * * *